United States Patent [19]

McKee

[11] Patent Number: 4,738,313

[45] Date of Patent: Apr. 19, 1988

[54] GAS LIFT OPTIMIZATION

[75] Inventor: Fount E. McKee, Houston, Tex.

[73] Assignee: Delta-X Corporation, Houston, Tex.

[21] Appl. No.: 16,905

[22] Filed: Feb. 20, 1987

[51] Int. Cl.[4] ..... E21B 43/12; E21B 43/18

[52] U.S. Cl. ..... 166/372; 166/53

[58] Field of Search ..... 166/372, 53, 64, 65.1, 166/66, 68, 250; 417/54, 108, 109, 111

[56] References Cited

U.S. PATENT DOCUMENTS

| | | | |
|---|---|---|---|
| 2,951,451 | 9/1960 | Vincent | 417/54 |
| 4,150,721 | 4/1979 | Norwood | 166/53 |
| 4,267,885 | 5/1981 | Sanderford | 166/372 X |
| 4,352,376 | 10/1982 | Norwood | 166/53 X |
| 4,410,038 | 10/1983 | Drapp | 166/53 |
| 4,596,516 | 6/1986 | Scott et al. | 166/53 X |
| 4,633,954 | 1/1987 | Dixon et al. | 166/372 |

*Primary Examiner*—Stephen J. Novosad

*Attorney, Agent, or Firm*—Fulbright & Jaworski

[57] ABSTRACT

Optimizing the production of well fluids from a well by controlling the injection gas flow rate. Determining the time delay for various gas flow rates to produce a constant liquid flow rate and determining the relationship between the injection gas flow rate and the amount of liquids produced and calculating the required injection gas flow rate to produce a selected amount of liquids. Thereafter the gas flow rate is adjusted considering the determined time delays to reach the required injection gas flow rate without injecting more gas than is needed.

7 Claims, 5 Drawing Sheets

GAS LIFT OPTIMIZATION

BACKGROUND OF THE INVENTION

This invention relates to the control and optimization of profit from an oil well produced by gas lift.

The typical gas lift system is designed based on a given inflow performance relationship (IPR) and injected gas flow rate. However, with fixed installations, the IPR and injected gas flow rate usually change as a function of time. Once the system is installed, any changes that are made to improve efficiency are generally made at intervals of weeks. This invention employs equipment and techniques which make changes continuously to optimize the profit or production.

The desire to optimize gas lift production is not new. However, the equipment and technology capable to do so are relatively new. A definition for gas lift optimization that most people would agree with is to "obtain the maximum output under specified operating conditions." This definition does not indicate that maximum production is considered to be optimum although it could be. Producing maximum profit should be the goal of optimization. However, since a non-linear economic relationship exists between the amount of gas required to produce a well and the amount of produced oil, as shown in FIG. 2, the maximum profit from a well is not normally achieved when maximum produced oil or liquid is achieved. In addition, the costs of using the gas required and the value of the produced oil must also be considered.

There are several factors that affect the quantity of produced liquid of a gas lift installation. Certainly, the original design of the well is a major factor. The tubing size, depth and location of the injection valves are of prime importance. The reservoir as described by the productivity index or IPR curve is another important factor. However, if the problem is to optimize existing installations, little can be done about these parameters. For a given installation, the following parameters can be controlled such that the given installation can be made to produce the maximum profit of which it is capable. These parameters are injection gas supply, amount of produced liquid, control of injection gas and the method of control of the injection gas. For the purpose of this discussion, it will be assumed that the injection gas supply will always be adequate. This leaves only the measurement of the produced liquid, control of injection gas and the method of control that can be dealt with to optimize the production or profit of a gas lift well.

Because the quantity of produced liquid is used to control the injection gas flow rate, it is necessary to understand the relationship between the quantity of produced liquid and the flow rate of injection gas. FIG. 1 shows two curves. Curve number 1 is the inflow performance (IPR) curve. Curve number 2 is the tubing performance curve for a given size of tubing and a constant gas-liquid ratio. These two curves contain the primary information used in the design and optimization of gas lift wells. The intersection of these two curves at point A represents a stable operating condition. That is, the well will always operate at point A. The intersection at point B is unstable and the well will not operate at this point. Therefore, all of this discussion will be concerning the intersection at point A.

The intersection at point A will change as a function of the IPR curve 1 and the tubing performance curve 2.

The IPR curve changes over time. As the reservoir pressure declines, the IPR curve will move downward. First, the following discussion assumes that the tubing performance curve 2 remains constant. Therefore, point A will move to the left which means that less liquid will be produced. Also, the IPR curve is affected by the operation of nearby wells. The reservoir pressure can change daily as a result of nearby wells being taken off or brought on line. If the reservoir pressure increases, the IPR curve will move upward. This means that point A will move to the right and more liquid will be produced. If the reservoir pressure decreases the IPR curve will move downward, point A will move to the left and less liquid will be produced. Therefore, a movement upward of the IPR curve will cause more liquid to be produced and a movement downward will cause less liquid to be produced.

Now, the following discussion assumes that the IPR curve 1 remains constant. The tubing performance curve 2 moves in an up and down direction as a function of the injection gas flow rate and flow line pressure. If the injection gas flow rate is less than that required to produce the maximum quantity of liquid, the tubing performance curve 2 will be moved upward and the intersection (point A) will be moved to the left. This means less liquid produced. As the injection gas flow rate is increased, the tubing performance curve 2 will move downward, point A will move to the right and more liquid will be produced. As the injection gas flow rate is increased, the tubing performance curve 2 will continue to move downward and more liquid will be produced. However, this continued increase in produced liquid does have a limit. When this limit is reached, any further increase in injection gas flow rate will cause the intersection at point A to move back to the left and in an upward direction and less liquid will be produced. Actually, the shape of the tubing performance curve 2 changes more than the entire curve shifting up and down. Therefore as can readily be seen, if the injection gas flow rate exceeds a given value, any further increases will cause a reduction in produced liquid.

From the above discussion, it can be seen that in order to optimize a gas lift well, the intersection of the IPR curve 1 and the tubing performance curve 2 or point A must be controlled. Actually, relatively little can be done with IPR curve. Therefore, the major element of control lies in the control of the tubing performance curve (curve No. 2). And after an installation is complete, only the injection gas flow rate can be controlled. Therefore, the present invention is directed to the control of the injection gas flow rate.

SUMMARY

The present invention is generally directed to a closed loop control method and apparatus and a manual input provides a desired liquid production from the well. Measurements are taken of the actual liquid production and injection gas flow rate and a gas flow rate is calculated to produce the selected amount of liquids. Thereafter, the gas flow rate is changed considering the delay time of between changing the gas flow rate and detecting the results of this change. The change in the gas flow rate causes a change in the quantity of produced liquid. The quantity of produced liquid is measured and the cycle begins again.

A further object of the present invention is the method and apparatus for optimizing the production of well fluids from a well by gas lift and includes determining the time delay for various constant injection gas flow rates to produce a constant liquid flow rate and determining the relationship between the injection gas flow rate to the well and the amount of liquid produced from the well between a minimum and a maximum gas flow rate. Next the amount of liquid is selected which is desired to be produced and a determination is made of the required injection gas flow rate required to produce the desired amount of liquid. While measuring the amount of fluids produced from the well and the injection gas flow rate, the difference between the present gas flow rate and the required gas injection flow rate to produce the selected amount of liquids is calculated. Thereafter, the gas flow rate is adjusted considering the determined time delays to reach the required injection gas flow rate without injecting more gas than is needed.

A still further object of the present invention is wherein the amount of liquid selected is a constant produced liquid flow rate.

Still a further object of the present invention is wherein the amount of liquid selected is a constant ratio of injection gas flow rate to produce the liquid flow rate for providing maximum profitability.

Still a further object of the present invention is wherein the time delay is determined by measuring the injection gas flow rate and measuring the produced liquid flow rate at periodic intervals for various different constant injection gas flow rates.

Yet a still further object of the present invention is wherein the relationship between the injection gas flow rate and the amount of liquid produced is determined by measuring the injection gas flow rate and measuring the produced liquid flow rate while varying the injection gas flow rate between minimum and maximum gas flow rates.

Yet a still further object of the present invention is the provision of an apparatus for optimizing the production of well fluids from a well by gas lift including means for measuring the amount of well fluids produced from the well and means adapted to be connected to a supply of injection gas for measuring the injection gas flow rate of gas injected into the well, and means adapted to be connected to the supply of injection gas for controlling the flow rate of injection gas to the well. Computing and control means are connected to the well fluids measuring means, the injection gas flow measuring means, and the means for controlling the flow rate of the gas. The computing and control means receives measurements of the fluids produced and measurements of the injection gas flow rate and also receives a selected desired liquid production rate. The control means adjusts the gas flow rate, for producing the selected liquid production rate, by adjusting the gas flow rate considering any time delay required to reach the gas flow rate to produce the selected liquid production rate without injecting more gas than needed.

Other and further objects, features and advantages will be apparent from the following description of a presently preferred embodiment of the invention, given for the purpose of disclosure and taken in conjunction with the accompanying drawings.

BRIEF DESCRIPTION OF THE PREFERRED EMBODIMENT

Figure 2:
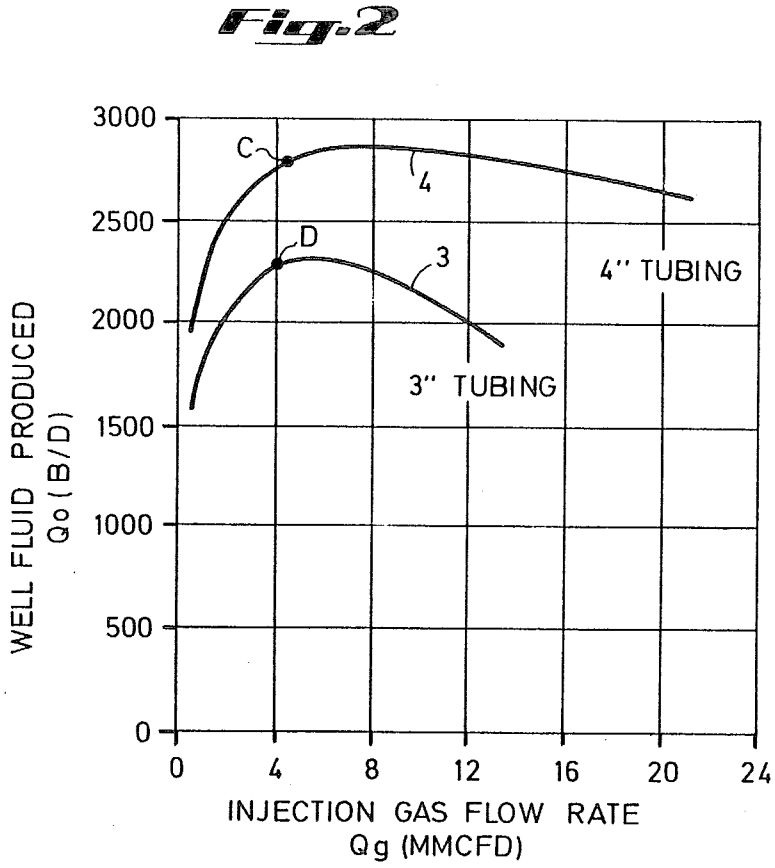
FIG. 2 are graphs of the relationship between injection gas flow rate and produced well fluids flow rate for two different sized well tubings.

Referring now to FIG. 2, the relationship between the quantity of well fluids produced and the injection gas flow rate for two different sizes of well tubing is shown.

Figure 1:
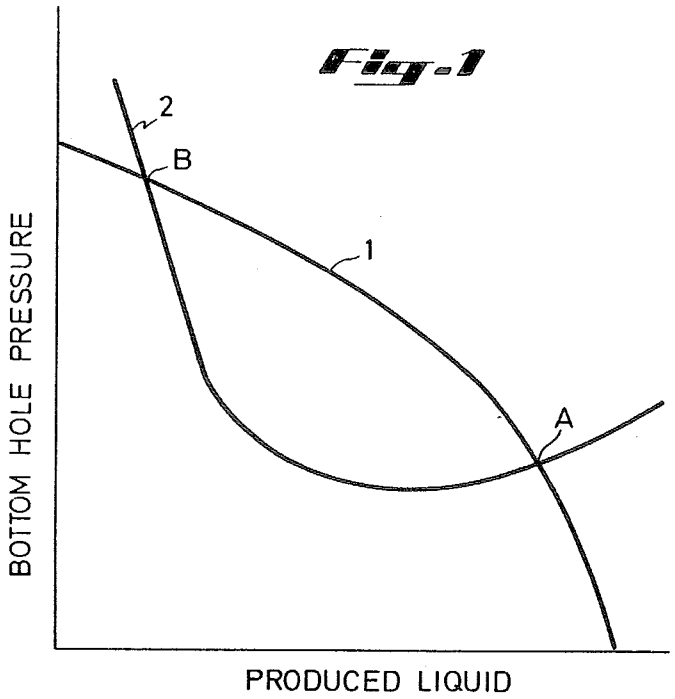
FIG. 1 are graphs of a well inflow performance curve and a tubing curve.

These curves are the loci of point A in FIG. 1 as the injection gas flow rate is varied. The top curve 4 is for 4.00 inch I.D. tubing and the bottom curve 3 is for 3.00 inch I.D. tubing. From these curves, the maximum injection gas flow rate can easily be determined. For this particular installation, the maximum effective injection gas flow rate for the 4.00 inch tubing is 7.2 million standard cubic feet per day (MMSCFD) and for the 3.00 inch tubing is 4.7 MMSCFD. The maximum allowed injection gas flow rate is an important parameter to be considered in any automatic control system. Under no circumstances, if maximum profit is the goal, should the system be allowed to inject gas at a rate greater than this.

When considering the cost of providing the injection gas relative to the market value of the liquid produced, it is unlikely that the injection gas flow rate required to produce the maximum quantity of liquid would be selected. The curve 4 for the 4.00 inch I.D. tubing shows that a decrease from 7.2 MMSCFD to 4.00 MMSCFD (a 44% decrease) produces only a 2.8% decrease in liquid production. Therefore, the system would be adjusted to maximize profit such as by operating somewhere near point C on the 4.00 inch I.D. tubing curve and point D on the 3.00 inch I.D. tubing curve. Therefore, the system should be set up to operate at a constant gas to liquid ratio with the capability of changing the operating points. (However, the present system is also designed to operate in other modes as will be discussed hereinafter.)

The general closed loop control process of the present invention generally operates as follows:

A. Desired results are specified.
B. Control device changed to produce desired results of the process considering a delay factor.
C. Measure results of the process.
D. Compare measured results with desired results.
E. Change control devices based on difference between measured and desired results.

Figure 3:
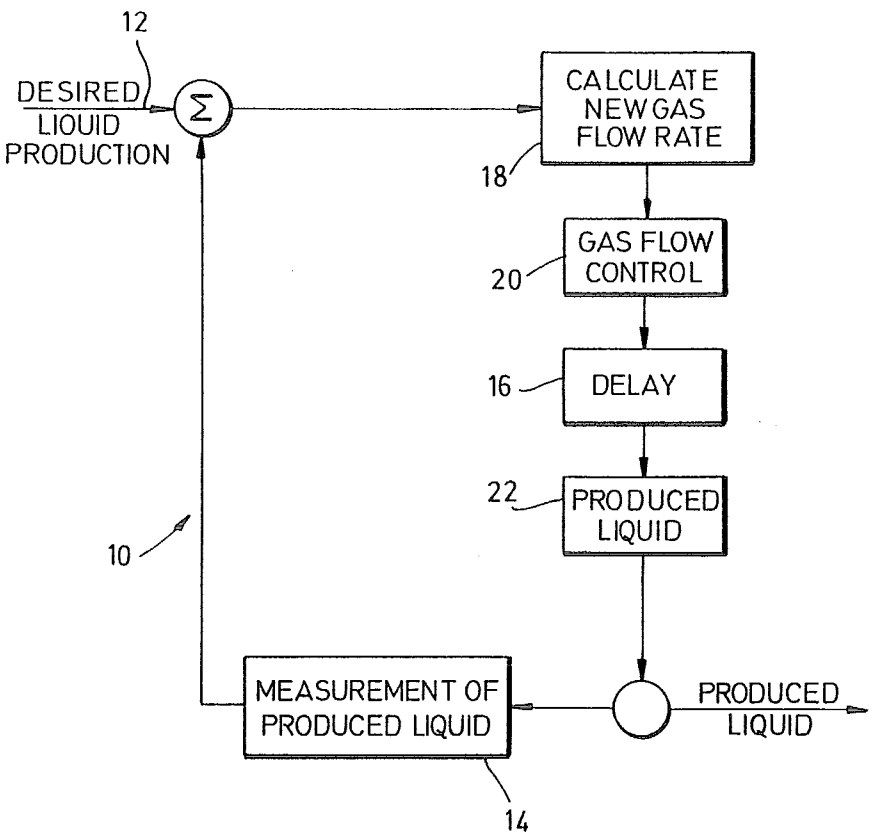
FIG. 3 is a schematic representation of a closed loop gas lift control system.

FIG. 3 shows the schematic representation of a closed loop gas lift control system generally indicated by the reference numeral 10. The manual input 12 to the system is the desired liquid production. The desired liquid production is compared to the actual measured 14 liquid production. The block 16 labeled "DELAY" in this diagram represents the time between changing the gas flow rate and detecting the results of this change. The next step is that a new gas flow rate is calculated 18 based on the measured production 14 and the desired production 12, keeping the gas to liquid ratio constant. Once the new gas flow rate has been determined, the gas flow rate control valve 20 is changed to accommodate the new flow rate. The change in injection gas flow rate causes a change in the quantity of produced liquid 22. The quantity of produced liquid is measured at 14 and the cycle begins again.

In order to optimize the operation of the well, the delay 16 should be as short as possible. The length of time of the delay controls how rapidly the gas flow rate can be changed. If the length of time of the delay is long, then the gas flow rate must be changed very slowly. If the length of time of the delay is short, then the gas flow rate can be changed more rapidly. If the gas flow rate is changed too rapidly, the system will oscillate which must be avoided under all circumstances. Oscillation causes a decrease in profitability. The delay is a function of gas flow rate, well depth, time between measurements of the liquid production and liquid production rate. For a given well, the delay can be calculated fairly accurately. Once the delay is known, the maximum rate of change for the gas flow rate can be calculated or is preferably measured in a setup test. For a given well, the delay caused by gas flow rate, well depth and liquid production rate remains fairly constant. Therefore, the major item over which control can be exercised is the time between measurements of the liquid production which will be called the sampling rate. This means that the more rapid the sampling rate, the closer the approach to optimum operation.

The efficiency of gas lift systems can be improved by using modern technology in electronics and transducers and closed loop control methods. By using the time between production measurements, the entire gas lift system can be made to respond rapidly to the variations in the reservoir conditions. An efficient and responsive system means more profit.

Figure 4:
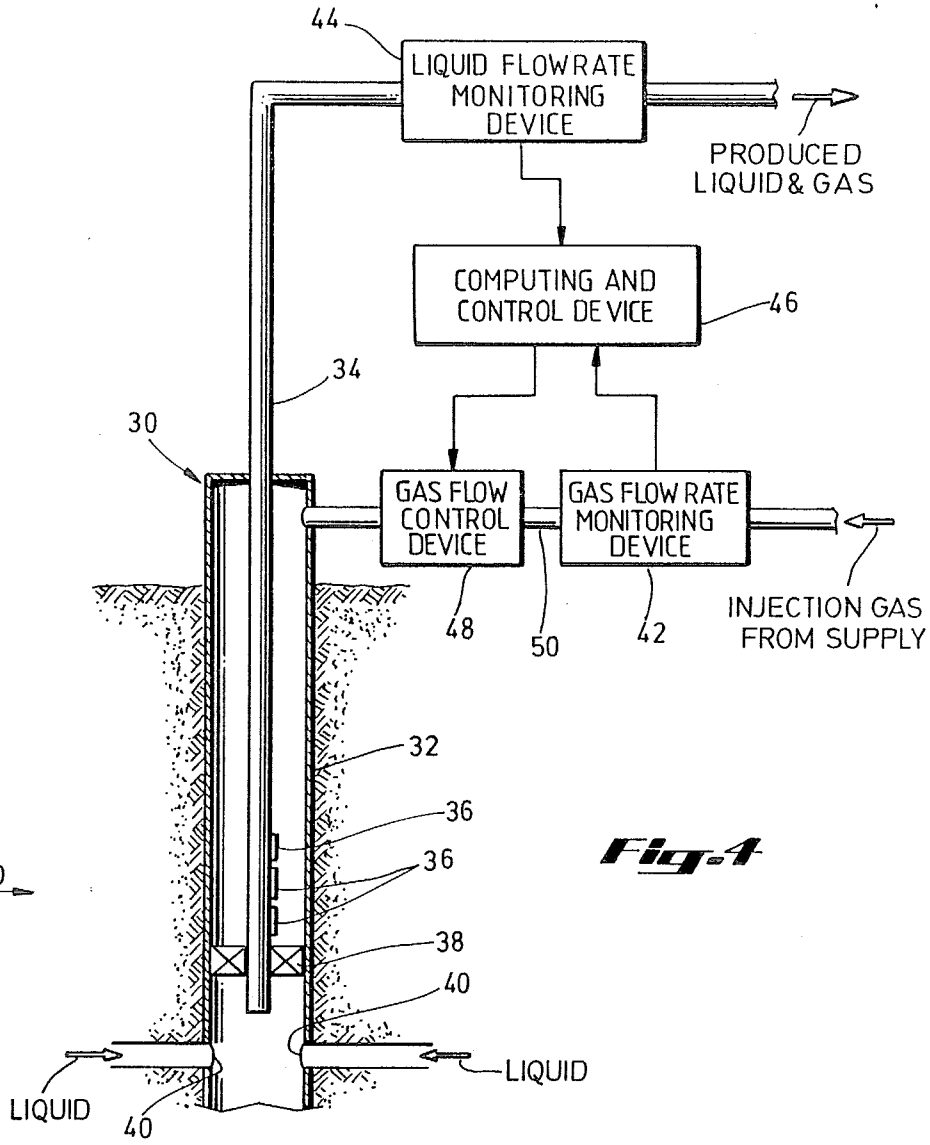
FIG. 4 is an elevational schematic view of the control system of the present invention.

Referring now to FIG. 4 a conventional oil well, generally indicated by the reference numeral 30 is shown, having a casing 32, production tubing 34, gas lift valves 36, a well packer 38, and liquid inlets 40 in the casing 32. In gas lift, gas is injected into the annulus between the casing 32 and the production tubing 34 and enters the lowest of the gas lift valves 36. The gas is then injected into the well liquid coming from the inlets 40 to lift the well fluids upwardly through the production tubing 34. In the present invention injection gas is received from a supply and is transmitted through a conduit 50 into the casing 32. Means 42 are provided in the conduit 50 for measuring the injection gas flow rate and conventional means 44 are provided connected in the production tubing 34 for measuring the well fluids produced through the production tubing 34. A computing and control device 46 is provided which receives the measurements from the gas measuring means 42 and the production well fluids measurement means 44 and in turn controls a gas flow control device 48 such as a valve.

The present system may have different operating modes. They are (1) set up, (2) constant injection gas flow rate, (3) constant produced liquid flow rate, and (4) constant injection gas flow rate to produced liquid flow rate ratio. In order to set up and operate the system, the operator must have a means for communicating with the computing and control device 46. This means will typically be a small portable computer or a larger computer which will communicate by means of radio or hardwire. The computing and control device 46 will typically be a microprocessor based device, such as Delta-X Corporation Model DXI-40A.

When the system is first turned on, the operator can set the system in the set up mode to determine the relationship shown by a curve such as shown in FIG. 2 or enter the produced liquid flow rate versus injected gas flow rate from calculated data. If the operator selects the set up mode, the minimum and maximum injection gas flow rate, number of steps between minimum and maximum injection gas flow rates, and the time to remain at each injection gas flow rate must be entered into the computing and control device 46. These are values which are calculated and selected to restrict the set up tests to a reasonable range and avoid wasting gas.

When the above data is entered, the computing and control device 46 will adjust the gas flow control device 48 such that the injection gas flow rate as measured by the gas flow monitoring device 42 is the specified minimum. The computing and control device 46 will record the produced liquid flow rate as measured by the liquid flow rate monitoring device 44 at desired intervals, such as one minute for the entire time that the injection gas flow rate remains constant at this value. This data (produced liquid flow rate versus time) will be used later to determine the delay time of the system. The produced liquid flow rate will be averaged over the latter portion the time increment and recorded as the produced liquid flow rate for this gas injection flow rate.

The above procedure will be carried out for each value of injection gas flow rate until the maximum injection gas flow rate has been achieved. This completes the set up mode of operation. The produced liquid flow rate versus injection gas flow rate curve (similar to FIG. 2) will be used by the computing and control device 46 to determine the injection gas flow rate when operating in the constant produced liquid or constant injection gas flow rate to produced liquid flow rate ratio modes. However, this information is not required when operating in the constant injection gas flow rate mode.

The operator must retrieve the produced liquid flow rate versus time data to determine the delay time of the system. The operator enters this system delay time in the computing and control device 46. The system delay time is used by the computing and control device 46 to control the rate at which the injection gas flow rate is changed by the gas flow rate control device 48. Therefore, the injection gas flow rate can be changed at the maximum rate allowed to prevent oscillation of the system. If the operator does not select the set up mode, the system delay time and the produced liquid flow rate as a function of injection gas flow rate must be entered by the operator from calculated data. However, since the set up mode measures well conditions as they actually exist, it is preferred over calculated data.

Once the set up procedure has been completed, the system can be set in any one of the three operating modes. They are (1) constant injection gas flow rate, (2) constant produced liquid flow rate, and (3) constant injection gas flow rate to produced liquid flow rate ratio.

Only mode 3 will provide maximum profitability. However, the other modes may be desired for other reasons and the present system and method provides a flexible operation to meet any desired operating condition.

If the constant injection gas flow rate mode is selected, the computing and control device 46 monitors the injection gas flow rate by means of the gas flow rate monitoring device 42 and varies the gas flow control device 48 to maintain a constant injection gas flow rate.

If the constant produced liquid flow rate mode is selected, the computing and control device 46 monitors both the produced liquid and injection gas flow rate. If the produced liquid flow rate varies from the specified value, the computing and control device will compute a new injection gas flow rate from data obtained in the set up mode. The gas flow control device 48 will be changed as a function of the system delay time.

If the constant injection gas flow rate to produced liquid flow rate ratio is selected, the computing and control device 46 monitors both the produced liquid flow rate and the injection gas flow rate. If the ratio of the injection gas flow rate to the produced liquid flow rate changes, the computing and control device 46 calculates a new gas flow rate based on the produced liquid flow rate versus injection gas flow rate and the desired ratio of the injection gas flow rate to produced liquid flow rate obtained in the setup mode. The gas flow control device 48 will be changed as a function of the system delay time.

Figure 5:
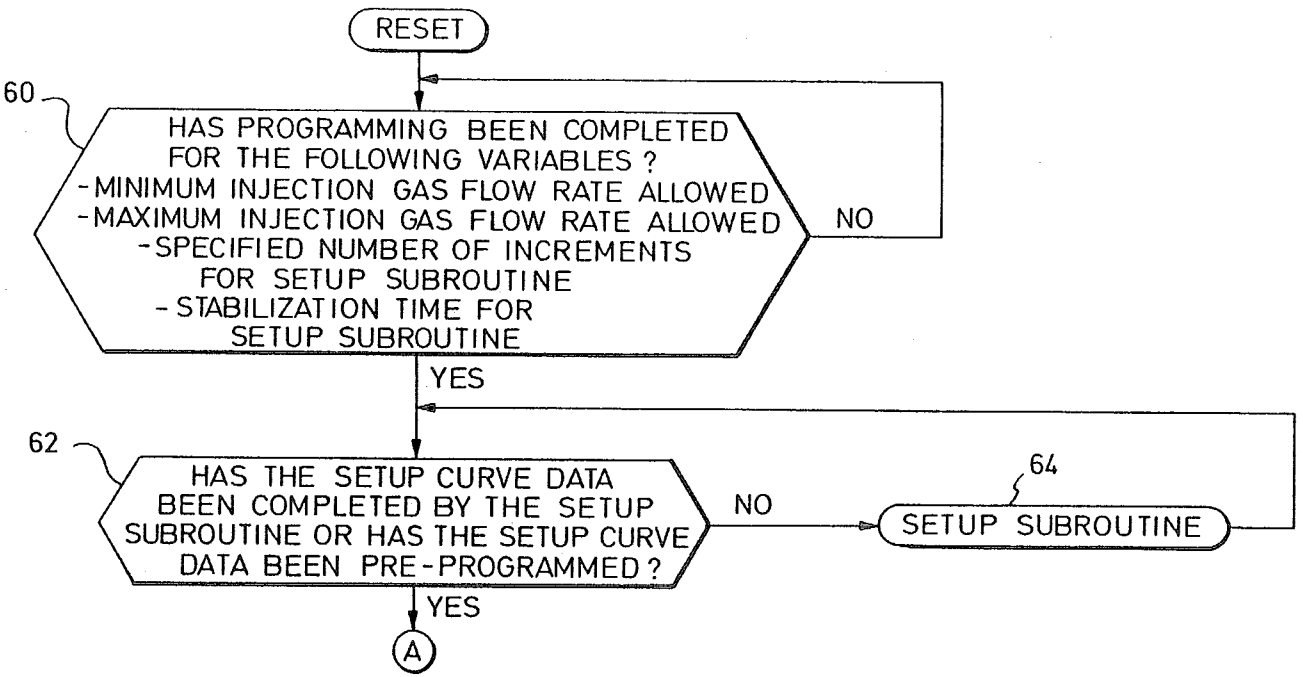
FIGS. 5, 6, 7 and 8 are logic flow charts of the operation of the present invention.
Figure 6:
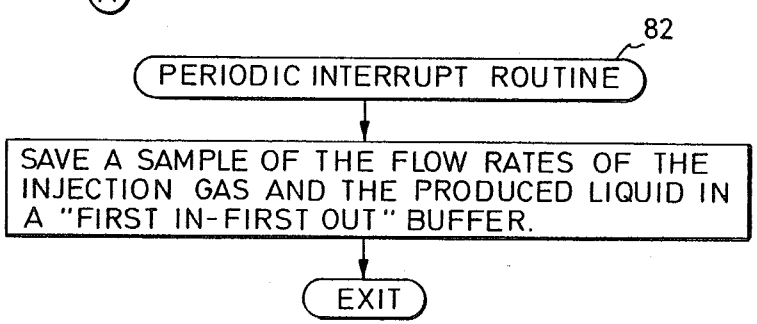
Figure 7:
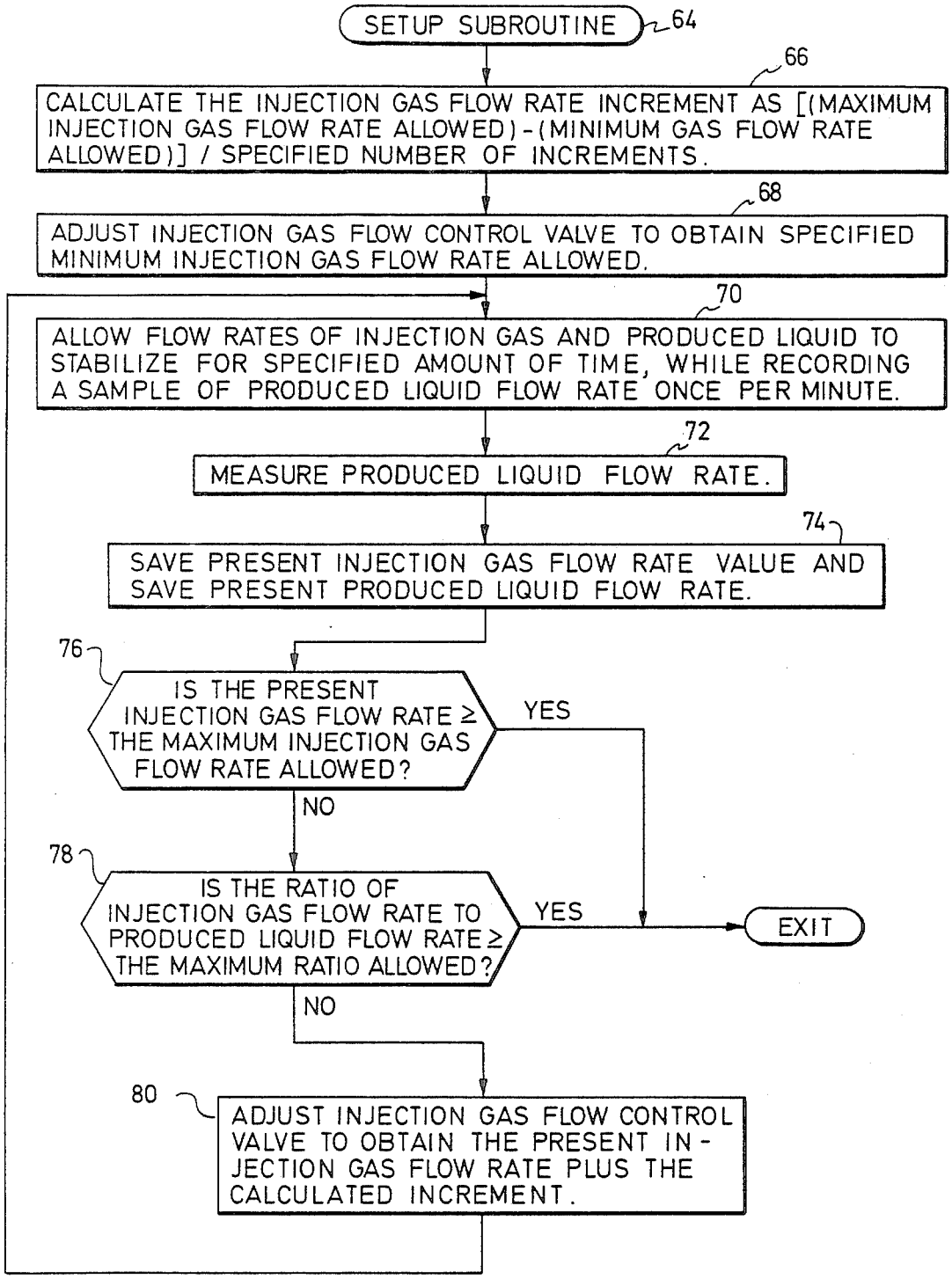

Referring now to FIGS. 5–8, a logic flow chart of the preferred operation of the present invention is best seen. FIGS. 5 and 7 set forth the steps to be performed in order to provide the necessary background data for the operating modes of constant produced liquid flow rate or constant injection gas flow rate to produce liquid flow rate ratio. The setup mode basically determines the time delay for various constant injection gas flow rates to produce a constant liquid flow rate and also determines the relationship between injection gas flow rate to the well and the amount of liquid produced from the well between a minimum and maximum gas flow rate. (The information in the curve of FIG. 2.) As an alternative to the setup mode, these relationships may be calculated and entered to provide the necessary data for the operating modes. However, since the setup mode measures well conditions as they actually exist, the setup mode is preferred.

Referring now to step 60 in FIG. 5, minimum and maximum injection gas flow rates are manually entered which are calculated values to establish the range over which the well may be allowed to operate along with the number of increments or steps to be measured between the minimum and maximum injection gas flow rates along with the time to remain at each increment.

In step 62 a determination is made whether or not all of the background data has been inserted and if not the setup routine is actuated in step 64 as set forth in FIG. 7. The subroutine begins in step 66 by calculating the number of injection gas flow rate increments or steps to be measured from the relationship of programmed maximum and minimum gas flow rates and the specified number of increments or steps. In step 68, the first test is initiated at the specified minimum injection gas flow rate by controlling the gas flow control device or valve 48 (FIG. 4). In step 70, for each of the increments data will be obtained of the produced liquid flow rate as measured by the liquid flow rate monitoring device 44 at desired intervals such as one minute for the entire time that the injection gas flow rate at each increment or step remains constant. During this time in step 72 the produced liquid flow rate is measured and the information as to the gas flow rate, liquid flow rate and time, is saved to be used at a later time to determine the delay time of the system. Steps 76, 78, and 80 determine the procedure to be carried out for each increment or value of injection gas flow rate until the maximum injection gas flow rate has been achieved. Referring to FIG. 6, a periodic interrupt routine 82 is provided to periodically save data of the relationship of the flow rates of the injection gas and the produced liquid. This completes the setup subroutine and provides the data necessary to provide the delay time and the relationship of the produced liquid flow rate versus injection gas flow rate which will later be used to determine the injection gas flow rate when operating in the constant produced liquid or constant injection gas flow rate to produce liquid flow rate ratio modes.

Figure 8:
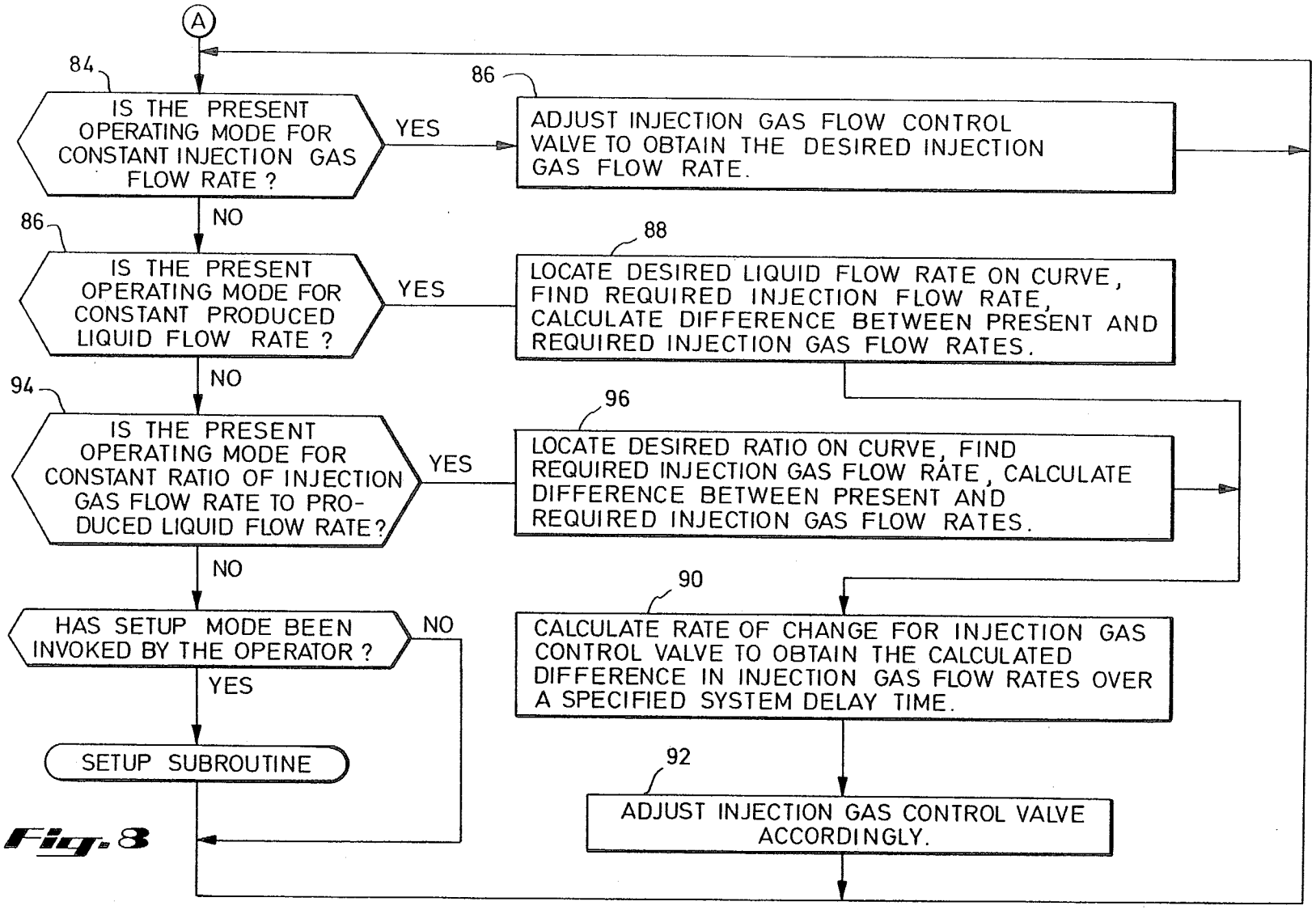

Referring now to FIG. 8, the various operating modes are set forth. In step 84, if the constant injection gas flow rate is selected, step 86 adjusts the gas flow control valve 48 to the desired gas flow rate to maintain a constant injection gas flow rate. This mode is not provided for maximum profitability and does not need the data provided in the subroutine setup, but has been added to the present operation to provide flexibility to the system.

If the constant produced liquid flow rate mode is selected in step 86, step 88 uses the information obtained in the setup mode to calculate the difference between the present and required injection gas flow rates and then moves to step 90 using the delay time obtained in the setup routine to calculate the change in the rate of injection gas to reach the required injection gas flow rate without injecting more gas than is needed and adjusts, in step 92, the gas valve 48 accordingly.

If the system is to operate in the mode for constant ratio of injection gas flow rate to produce liquid flow rate, step 94 is actuated to initiate step 96 which again uses the relationship between the injection gas flow rate and the amount of liquid produced which was determined in the setup routine to calculate the difference between the present and required injection gas flow rates to produce the desired amount of liquid.

Thereafter, the system advances to step 90 to again use the delay time determined in the subroutine to change the rate of injection gas without allowing the system to oscillate and moves to step 92 to adjust the gas control valve 48.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, and steps of the process, will be readily apparent to those skilled in the art and which are encompassed within the spirit of the invention and the scope of the appended claims.

What is claimed is:

1. A method of optimizing the production of well fluids from a well by gas lift comprising, determining the time delay for various constant injection gas flow rates to produce a constant liquid flow rate, determining the relationship between the injection gas flow rate to the well and the amount of liquid produced from the well between a minimum and a maximum gas flow rate, selecting the amount of liquids which are desired to be produced and determine the required injection gas flow rate required to produce the desired amount of liquid, measuring the amount of fluids produced from the well and the injection gas flow rate, calculating the difference between the present injection gas flow rate and the required injection gas flow rate to produce the selected amount of liquids, and adjusting the gas flow rate considering the time delays to reach the required injection gas flow rate without injecting more gas than is needed.

2. The method of claim 1 wherein the amount of liquid selected is a constant produced liquid flow rate.

3. The method of claim 1 wherein the amount of liquids selected is a constant ratio of injection gas flow rate to produced liquid flow rate.

4. The method of claim 1 including, periodically measuring the amount of fluids produced from the well and the injection gas flow rate, periodically calculating the difference between the present injection gas flow rate and the required gas flow rate to produce the selected amount of liquids, and periodically adjusting the gas flow rate depending on the determined time delays to reach the required injection gas flow rate without injecting more gas than is needed.

5. The method of claim 1 wherein the time delay is determined by measuring the injection gas flow rate at periodic intervals for various different constant injection gas flow rates.

6. The method of claim 1 wherein the relationship between the injection gas flow rate and the amount of liquid produced is determined by measuring the injection gas flow rate and measuring the produced liquid flow rate while varying the injection gas flow rate between minimum and maximum gas flow rates.

7. An apparatus for optimizing the production of well fluids from a well by gas lift comprising, means adapted to be connected to the well for measuring the amount of well fluids produced from the well, means adapted to be connected to a supply of injection gas for measuring the injection gas flow rate of gas injected into the well, means adapted to be connected to the supply of injection gas for controlling the flow rate of injection gas to the well, computing and control means connected to the means for measuring the amount of well fluids, the means for measuring the injection gas flow rate, and the means for controlling the flow rate of the injection gas, said computing and control means receiving the measurements of the fluids produced, and the measurement of the injection gas flow rate, and receiving a selected liquid production rate, and adjusting the means for controlling the flow rate of the injection gas, for producing the selected liquid production rate, by adjusting the gas flow rate considering any time delay to reach the gas flow rate required to produce the selected liquid production rate without injecting more gas than needed.

* * * * *